US006651684B2

(12) United States Patent
Spitzer

(10) Patent No.: US 6,651,684 B2
(45) Date of Patent: Nov. 25, 2003

(54) FREE STANDING CANE

(76) Inventor: A. Robert Spitzer, 20180 W. Twelve Mile Rd., Suite 10, Southfield, MI (US) 48076

( * ) Notice: Subject to any disclaimer, the term of this patent is extended or adjusted under 35 U.S.C. 154(b) by 0 days.

(21) Appl. No.: 09/872,373

(22) Filed: Jun. 1, 2001

(65) Prior Publication Data

US 2002/0017596 A1 Feb. 14, 2002

Related U.S. Application Data

(60) Provisional application No. 60/209,021, filed on Jun. 2, 2000.

(51) Int. Cl.[7] ..... A45B 9/04; A61H 3/02
(52) U.S. Cl. ..... 135/78; 135/77
(58) Field of Search ..... 135/66, 77, 78

(56) References Cited

U.S. PATENT DOCUMENTS 4,091,828 A * 5/1978 Jorgensen
4,274,430 A 6/1981 Schaaf et al.
4,966,316 A * 10/1990 George
5,176,160 A * 1/1993 Osborn
5,433,234 A * 7/1995 Lapere
5,636,650 A * 6/1997 Kroeze
5,640,985 A * 6/1997 Snyder
5,755,245 A * 5/1998 Van Helvoort
5,810,466 A 9/1998 Young

* cited by examiner

*Primary Examiner*—Carl D. Friedman
*Assistant Examiner*—Kevin McDermott
(74) *Attorney, Agent, or Firm*—Kohn & Associates, PLLC

(57) ABSTRACT

According to the present invention, there is provided a cane including a handle, a hollow shaft, and a stand mechanism for standing the cane in an upright position upon its shaft. The stand mechanism is releasably retractable from within the hollow shaft through a hand grip mechanism manually operable by the user of the cane. Additionally, the present invention provides for an actuating mechanism extending from the handle, through the shaft and to stand mechanism for actuating the stand mechanism.

4 Claims, 3 Drawing Sheets

FREE STANDING CANE

CROSSREFERENCE TO RELATED APPLICATIONS

This application claims the benefit of priority under 35 U.S.C. Section 119(e) of U.S. Provisional Patent Application No. 60/209,021, filed Jun. 2, 2000, which is incorporated herein by reference.

BACKGROUND OF THE INVENTION

1. Field of the Invention

This invention generally relates to the field of ambulatory devices and specifically towards walking canes.

2. Description of Related Art

Walking canes are well known in the art. Canes are used by various disabled and elderly people who require aid and support during walking. There are various designs, styles and types of canes existing in the art. In addition to the standard cane, various attachments and designs have been created in aiding the user of the cane. For example, U.S. Pat. No. 5,810,466 to Young discloses a walking cane including an extending handle at an upper end for manipulating the cane and directionally controlling a flashlight in the handle to illuminate a travel path forwardly of the cane.

Most standard canes however, have an inherent problem when they are not being used—they cannot stand upright by themselves. Because canes generally are made of a single, narrow shaft, they must be held upright by a user or it must be leaned against a supporting structure such as a wall or a chair. Since it is nearly impossible to balance a cane in an upright position, the cane must be placed against or on a supporting structure or laid on the floor. Therefore, it is difficult for a user to store the cane when it is not being used.

There are existing inventions that have attempted to resolve this problem. For instance, U.S. Pat. No. 4,091,828 to Jorgensen discloses a walking cane with a collapsible stand located adjacent to its tip. The stand is shiftable from an extended position wherein the stand supports the cane in an upright attitude to a collapsed position wherein the stand nests neatly along the body of the cane above the tip. Additionally, the cane includes a manually manipulable remote control lever located below the handle of the cane to permit selective locking of the stand in either its extended or collapsed position. This walking cane includes the stand support located externally from the cane shaft and includes a cumbersome mechanism to allow the cane to be rested in an upright attitude. Additionally, the stand support is operated through a locking lever inconveniently located below the handle of the cane.

Another cane apparatus is described in U.S. Pat. No. 4,274,430 to Schaaf, et. al. This patent discloses a cane apparatus including a support structure having a foot support platform that is releasably mounted adjacent to the lower portion of the cane. As described therein, the support structure is used for assisting a person in walking up stairs, although it can be used to hold the cane upright. This support structure however, is conveniently maintained in a storage position, but cannot be conveniently released to an operable position. In order to release the support structure, the user must unlatch the support structure directly from the base of the cane apparatus, thus requiring the user to use his foot or the operator must bend over.

Accordingly, there is a need for a cane that can conveniently stand in an upright position by itself with only the aid of a conveniently operated support structure integrated into the aid thereof. Additionally, there is a need for a device that attaches to a cane that easily operates a supporting mechanism through a handle grip.

SUMMARY OF THE INVENTION

According to the present invention, there is provided a cane including a handle, a hollow shaft, and a stand mechanism for standing the cane in an upright position upon its shaft. The stand mechanism is releasably retractable from within the hollow shaft through a hand grip mechanism manually operable by the user of the cane. Additionally, the present invention provides for an actuating mechanism extending from the handle, through the shaft and to stand mechanism for actuating the stand mechanism.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
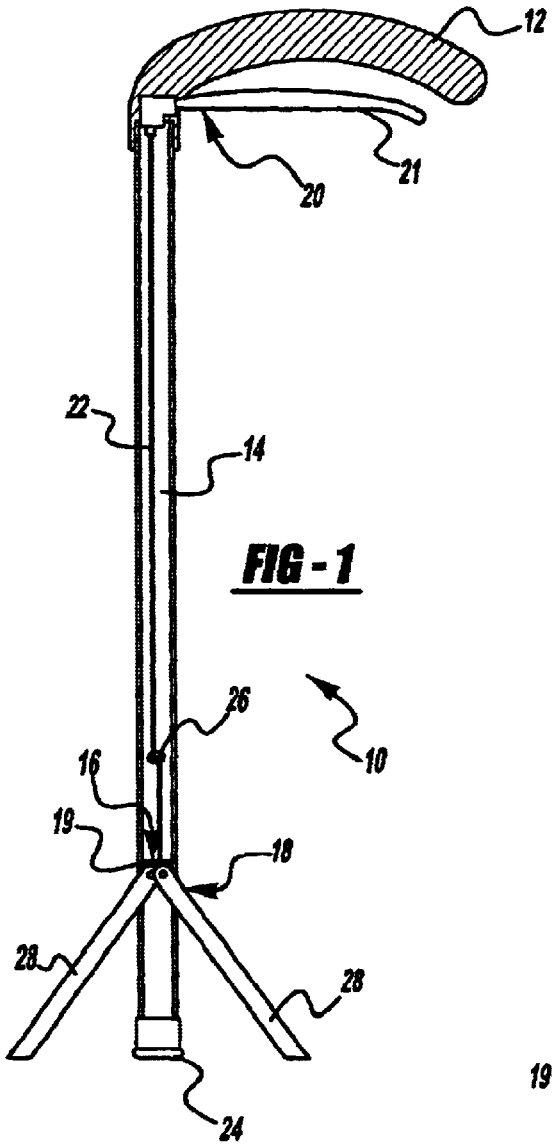
FIG. 1 is a cross-sectional, elevation view of an embodiment of the present invention including a support mechanism in an extended position engaged to a surface.
Figure 2:
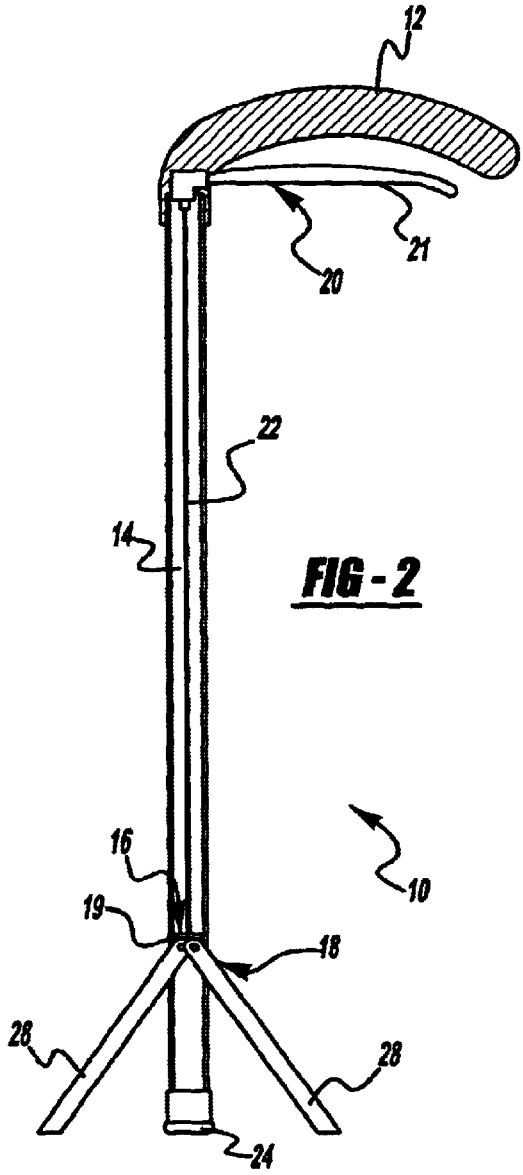
FIG. 2 is a cross-sectional, elevation view of another embodiment of the present invention including the support mechanism in an extended position engaged to a surface.
Figure 3:
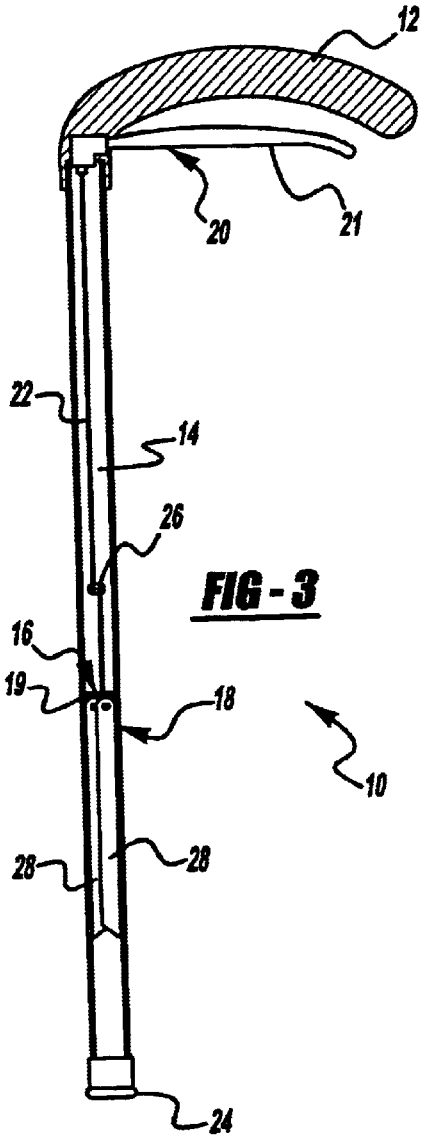
FIG. 3 is a cross-sectional, elevation view of another embodiment view of the present invention including the support mechanism in a retracted position within a hollow shaft of the cane.
Figure 4:
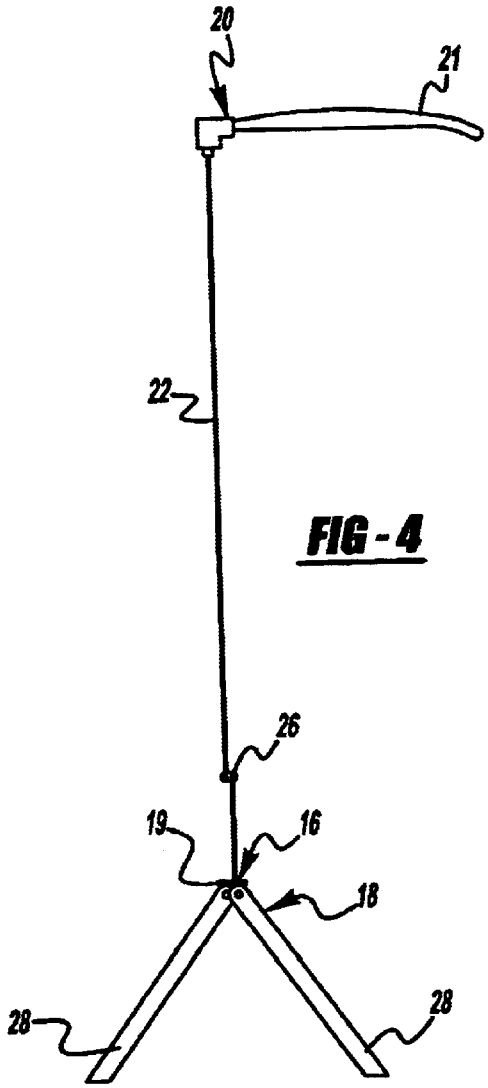
FIG. 4 is a elevational view of an embodiment of the standing mechanism having a hand grip mechanism, optional reversing mechanism, and support mechanism.
Figure 5:
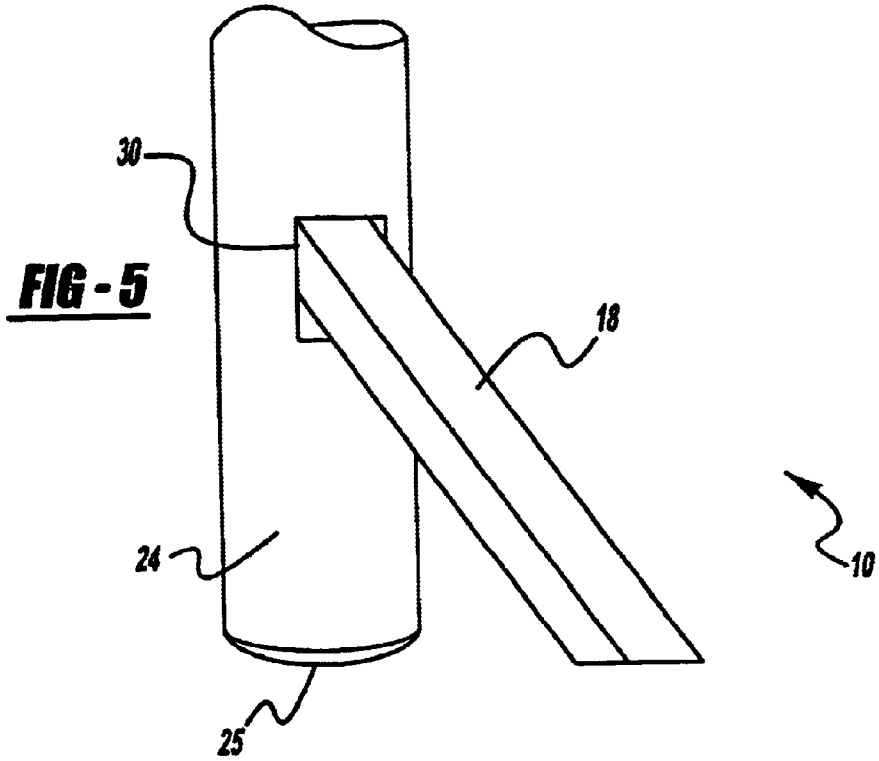
FIG. 5 is an enlarged elevational view of a base of the cane of the present invention including the support mechanism in an extended position engaged to the surface.
Figure 6:
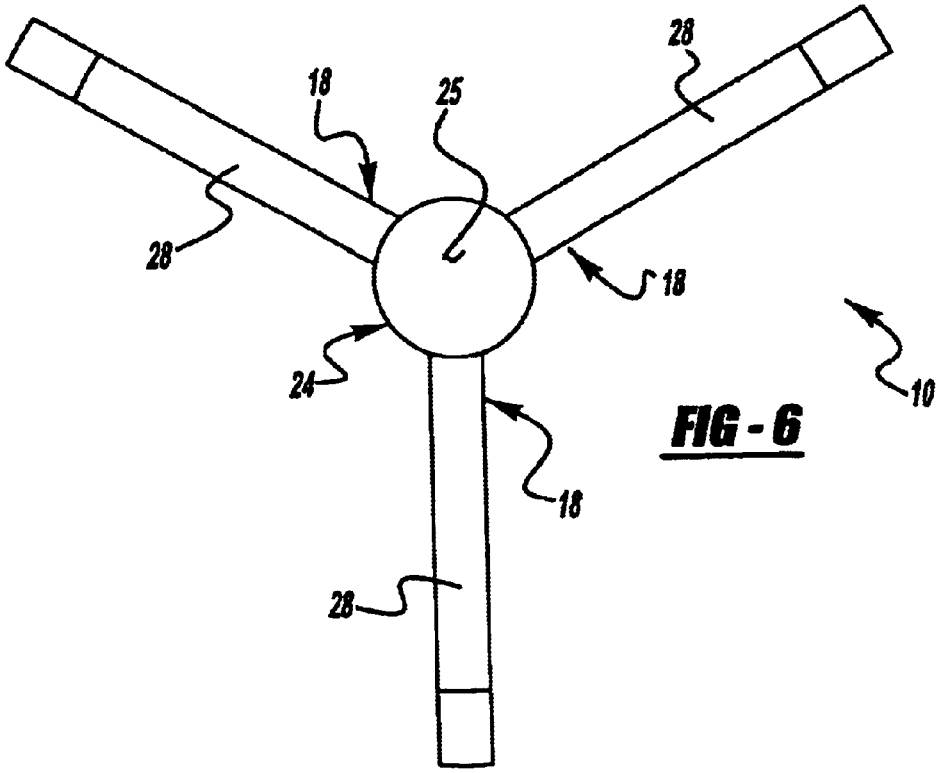
FIG. 6 is an enlarged bottom view of an embodiment of the present invention including the support mechanism having three legs in the extended position engaged to the surface.

Generally, the present invention provides for an improved cane that is free standing and self-supporting when it is not in use. The cane, generally shown at 10 in the Figures, includes a handle 12, a hollow shaft 14, and a stand mechanism 16. The stand mechanism 16 further includes a support mechanism 18 and a hand grip mechanism 20 operatively connected through a cable 22.

The cane 10 of the present invention can be constructed in a number of designs, styles and shapes. Generally, the cane 10 is made of materials including, but not limited to, metal, wood, ceramic, plastics, polymers, combinations thereof, and any other similar sturdy material known to those of skill in the art. Preferably, the cane's 10 hollow shaft 14 is substantially cylindrical in shape and is light-weight. Additionally, the cane 10 is either one continuous piece or is made of numerous pieces. The cane 10 must, however, have a handle 12 for the user to grip. The handle 12 is made of the same material as the cane 10 itself, or it can be made of materials including, but not limited to, rubber, cloth, foam, and any other similar gripping material known to those of skill in the art. The handle 12 can take on various shapes, each allowing for comfortable grip by the user. Finally, the base 24 of the cane 10 optionally includes a gripping surface 25, such as rubber or the like, that permits the cane to easily grip a ground surface.

The stand mechanism 16 includes a support mechanism 18 located at the base 24 and a handgrip mechanism 20 mounted proximate to the handle 12. Preferably, the hand grip mechanism 20 is operatively connected to the support mechanism 18 through a cable 22 that is made of materials including, but not limited to, metal, nylon, string, combinations thereof, and any other similar wire known to those of skill in the art. The handgrip mechanism 20 is for selectively releasing the support mechanism 18 from a retracted position in the shaft 14 to an extended position engaging the surface. In the retracted position, the support mechanism 18 can be located within the shaft 14 of the cane 10 or directly flush with the outer surface of the cane 10 at the base 24.

The support mechanism 18 further includes at least one elongate support leg 28 and a connecting mechanism 19 that connects the legs 28 to the cable 22. Although the support mechanism 18 can have a number of legs 28, the embodiments described herein have only three legs 28 symmetrically placed around the circumference of the cane 10. These legs 28, along with the entire support mechanism 18, are made of materials well known in the art. The legs 28 are made of materials including, but not limited to, metal, wood, ceramic, plastics, polymers, rubber, combinations thereof, and any other similar sturdy material known to those of skill in the art. In one embodiment of the present invention, the legs 28 extend through openings 30 located symmetrically around the circumference of the shaft 14 at the base 24 of the cane 10. Alternatively, in another embodiment, the legs 28 constitute the outer shell or surface of the shaft 14 at the base 24 of the cane 10 itself. These legs 28 are concealed and nestled on the outer surface of shaft 14 at the base 24 of the cane 10. Therefore, preferably, the legs 28 of the support mechanism 18 are not obvious when they are in their retracted position.

In an embodiment of the present invention, the stand mechanism 16 includes a reversing mechanism 26 for actively loosening the cable 22. The loosening of the cable 22 causes the support mechanism 18 to retract within the hollow shaft 14 of the cane 10 or directly flush with the outer surface of the cane 10 at the base 24. Alternatively, the reversing mechanism 26 actively tightens the cable 22 to cause the support mechanism 18 to retract within the hollow shaft 14 of the cane 10 or directly flush with the outer surface of the cane 10 at the base 24. The reversing mechanism 26 can be a simple spring-loaded swivel, swivel latch, or any other similar mechanism known to those of skill in the art. This reversing mechanism 26 is operatively connected to the handgrip mechanism 20 and the support mechanism 18. The handgrip mechanism 20 controls the reversing mechanism 26 by releasing or increasing the tension of the cable 22 and allowing the support mechanism 18 to return to the retracted position.

Another embodiment of the present invention does not have the reversing mechanism 26 and instead has the cable 22 operatively connecting the handgrip mechanism 20 directly to the support mechanism 18. In this embodiment, application of pressure to the handgrip mechanism 20 tightens and provides tension to the cable 22. When the cable 22 tightens, the cable 22 pulls the legs 28 of the support mechanism 18 into the shaft 14 of the cane 10 and maintains the entire support mechanism 18 in its retracted position. Alternatively, the cable 22 pulls the legs 28 directly onto the outer surface of the cane 10 at the base 24 so that the legs 28 are flush with the entire outer surface of the rest of the shaft 14. Once pressure is released from the handgrip mechanism 20, the cable 22 loosens and the support mechanism 18 is released from its retracted position to its extended position wherein the legs 28 of the support mechanism 18 engage the ground.

Although the embodiments described herein include a cable 22, any type of actuating mechanism known to those of skill in the art can be utilized to actuate the stand mechanism 16. The actuating mechanism extends from the handle, through the shaft 14, and to the stand mechanism 16.

Specifically, the handgrip mechanism 20 is a simple push-pull lever mechanism that is well known in the art. Such a lever mechanism includes, but is not limited to, a bicycle brake handle whereby the application of pressure by the user to the brake lever causes the cable connected thereto to tighten. There are additional mechanisms known to those of skill in the art.

In operation, users of the present invention would grasp the cane 10 by holding the handle 12 and applying pressure to a lever 21 of the handgrip mechanism 20 through their hands or fingers. When users do not require the cane 10, they simply release pressure from the handgrip mechanism 20 by removing their hand or fingers from the lever 21 therefrom. The release of pressure from the lever 21 of the handgrip mechanism 20 causes the legs 28 of the support mechanism 18 to radially extend outward toward the ground surface. Thus, the legs 28 of the support mechanism 18 engage the ground surface and allow the cane 10 to remain in an upright position without the aid of any additional support.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology that has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A cane comprising:

a handle;

a hollow shaft;

stand means for standing said cane upright upon its shaft, said stand means being releasably retractable into said shaft and including at least one support leg operatively connected by a cable to hand grip means for selectively releasing said stand means from a retracted position to an extended position; and reversing means for actively loosening said cable, whereby said reversing means retracts said support means.

2. The cane according to claim 1, wherein said reversing means actively loosens said cable when pressure is applied to said handle grip means.

3. The cane according to claim 1, wherein said reversing means actively tightens said cable when pressure is applied to id handle grip means.

4. The cane according to claim 2, wherein said reversing means includes a spring-loaded swivel mechanism.

* * * * *